US011130305B2

(12) United States Patent
Childress et al.

(10) Patent No.: US 11,130,305 B2
(45) Date of Patent: Sep. 28, 2021

(54) TRASH COMPACTOR ASSEMBLY

(71) Applicant: THE BOEING COMPANY, Chicago, IL (US)

(72) Inventors: Jamie J. Childress, Mercer Island, WA (US); Lindsey Flangas, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 398 days.

(21) Appl. No.: 16/106,808

(22) Filed: Aug. 21, 2018

(65) Prior Publication Data

US 2020/0061948 A1 Feb. 27, 2020

(51) Int. Cl.
*B30B 9/30* (2006.01)

(52) U.S. Cl.
CPC ..... *B30B 9/3042* (2013.01); *B30B 9/3032* (2013.01); *B30B 9/301* (2013.01); *B30B 9/3007* (2013.01)

(58) Field of Classification Search
CPC ... B30B 9/3042; B30B 9/3032; B30B 9/3007; B30B 9/301; B30B 9/3053; B30B 9/3046; B30B 9/3096; B30B 9/305; B30B 1/04; B30B 1/12; B30B 1/30; B30B 9/3071; B30B 9/3035; Y10S 100/915
USPC ..... 100/215
See application file for complete search history.

(56) References Cited

U.S. PATENT DOCUMENTS 6,007,025 A 12/1999 Coughren et al.
6,079,669 A 6/2000 Hanay et al.
7,100,872 B2 9/2006 Quan
7,191,701 B2 * 3/2007 Fukuizumi ..... B30B 9/3053 100/215
7,222,820 B2 5/2007 Wentland et al.
7,284,287 B2 10/2007 Cooper et al.
7,299,511 B2 11/2007 Quan
7,549,606 B2 6/2009 Quan
8,519,824 B1 8/2013 Rankin et al.
8,776,680 B2 7/2014 Zimmerman
9,415,873 B2 8/2016 McIntosh
2006/0289698 A1 12/2006 Quan
2008/0230640 A1 * 9/2008 Mussig ..... B30B 9/3021 241/100
2009/0038437 A1 2/2009 Huang
2012/0137902 A1 6/2012 Cunningham
2013/0036924 A1 * 2/2013 Ko ..... B30B 9/3053 100/214
2015/0203203 A1 7/2015 McIntosh
2016/0236785 A1 8/2016 McIntosh
(Continued)

OTHER PUBLICATIONS

U.S. Appl. No. 15/183,957.
U.S. Appl. No. 15/839,300.

*Primary Examiner* — Shelley M Self
*Assistant Examiner* — Teresa A Guthrie
(74) *Attorney, Agent, or Firm* — The Small Patent Law Group LLC; Joseph M. Butscher

(57) ABSTRACT

A trash compactor assembly includes a receptacle including a base connected to at least one wall having an upper edge. A retaining chamber is defined between the wall(s) and the upper edge. A compaction plate is disposed within the retaining chamber. The compaction plate is configured to be manually moved in an upward direction from the base towards the upper edge to compact trash within the retaining chamber.

20 Claims, 10 Drawing Sheets

(56) References Cited

U.S. PATENT DOCUMENTS

| | | | |
|---|---|---|---|
| 2017/0283062 | A1 | 10/2017 | Childress |
| 2017/0283092 | A1 | 10/2017 | Brown et al. |
| 2017/0284076 | A1 | 10/2017 | Jensen |
| 2017/0362026 | A1 | 12/2017 | McIntosh |

* cited by examiner

TRASH COMPACTOR ASSEMBLY

FIELD OF THE DISCLOSURE

Embodiments of the present disclosure generally relate to trash compactor assemblies, such as may be used within a lavatory of a commercial aircraft.

BACKGROUND OF THE DISCLOSURE

Commercial aircraft are used to transport passengers between various locations. A typical commercial aircraft includes one or more lavatories within an internal cabin.

A lavatory within an internal cabin includes a toilet, sink, and a trash container. Used paper towels, facial tissues, and the like may be disposed of within the trash container.

A typical trash container within a lavatory of a commercial aircraft has a limited volume. In particular, the volume of a known trash container used within an aircraft lavatory has a volume of approximately one cubic foot. As can be appreciated, during a flight, the trash container may be quickly filled. Indeed, during particularly long flights, the trash container may fill to the point of overflowing, thereby requiring flight staff to empty the contents of the trash container into another holding container, trash bags, and/or the like.

An aircraft may include a powered compactor within a galley. The compactor typically includes a motor that is used to effect compaction. However, such a compactor is large and heavy, and is used to compact relatively dense trash, including beverage cans, food containers, and/or the like. Typical compactors within a galley of an aircraft are generally too large to fit within the confined space of a lavatory.

In general, the lavatories onboard commercial aircraft do not include any trash compactor. As such, flight staff sometimes manually compact trash with their hands (for example, by pushing down on the trash with their hands) in order to provide a trash container with increased capacity to accept trash.

SUMMARY OF THE DISCLOSURE

A need exists for a compact and efficient trash compactor assembly, system, and method. Further, a need exists for a trash compactor assembly that may be employed within a lavatory of a commercial aircraft.

With those needs in mind, certain embodiments of the present disclosure provide a trash compactor assembly that includes a receptacle including a base connected to at least one wall having an upper edge. A retaining chamber is defined between the wall(s) and the upper edge. A compaction plate is disposed within the retaining chamber. The compaction plate is configured to be manually moved in an upward direction from the base towards the upper edge to compact trash within the retaining chamber.

The trash compactor assembly may include one or more rails that extend between the base and the upper edge. The compaction plate is slidably coupled to the receptacle through one or more rails. One or more slide brackets may slidably couple the compaction plate to the receptacle.

In at least one embodiment, a first pulley is coupled to the receptacle. The first pulley moveably couples to a cord that is coupled to the compaction plate.

A second pulley may couple to the compaction plate. The second pulley may also be moveably coupled to the cord.

A third pulley may couple to the compaction plate. The third pulley may also be moveably coupled to the cord. In at least one embodiment, the second pulley is secured to a first corner of the compaction plate, and the third pulley is secured to a second corner of the compaction plate that is diagonally opposite from the first corner.

An anchor may be secured to the receptacle. The cord may be secured to the anchor.

The trash compactor assembly may include a cord extending outwardly from the receptacle and coupled to the compaction plate. The cord has a free end that is configured to be outwardly pulled away from the receptacle. The compaction plate moves upwardly in response to the free end of the cord being outwardly pulled away from the receptacle.

The trash compactor assembly may include a securing collar that is removably secured to the upper edge of the receptacle. The securing collar is configured to removably retain an upper plate.

The trash compactor assembly may include an upper plate, which may be removably secured over the retaining chamber of the receptacle proximate to the upper edge. The compaction plate and the upper plate are configured to compact the trash therebetween.

In at least one embodiment, the upper plate includes a main body and a handle extending outwardly from the main body. The handle is configured to prevent an access door of a trash containment system from closing when the upper plate is positioned over the retaining chamber. The receptacle may include one or more plate retainers that are configured to retain the upper plate in a stored position.

Certain embodiments of the present disclosure provide a trash compacting method that includes providing a receptacle including a base connected to at least one wall having an upper edge (wherein a retaining chamber is defined between the at least one wall and the upper edge), disposing a compaction plate within the retaining chamber, and configuring the compaction plate to be manually moved in an upward direction from the base towards the upper edge to compact trash within the retaining chamber.

The trash compacting method may include coupling a first pulley to the receptacle, coupling a cord to the compaction plate, and moveably coupling the cord to the first pulley. The trash compacting method may also include coupling a second pulley to the compaction plate, and moveably coupling the cord to the second pulley. The trash compacting method may also include coupling a third pulley to the compaction plate, and moveably coupling the cord to the third pulley. The trash compacting method may also include securing an anchor to the receptacle, and securing the cord to the anchor.

In at least one embodiment, the trash compacting method includes removably securing an upper plate over the retaining chamber of the receptacle proximate to the upper edge.

Certain embodiments of the present disclosure provide a vehicle including an internal cabin, a lavatory within the internal cabin, and a trash containment system within the lavatory. The trash containment system includes an outer wall, an upper wall connected to the outer wall (wherein the upper wall includes a trash-receiving opening), and a trash compartment defined between the outer wall and the upper wall. An access door is moveably coupled to one or both of the outer wall and the upper wall. The access door is configured to be moved between an open position in which the trash compartment is exposed and a closed position in which the trash compartment is covered. A trash compactor assembly is positioned within the trash compartment.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Embodiments of the present disclosure provide a trash compactor assembly, system and method, which may be used within a lavatory of a vehicle, such as a commercial aircraft. The trash compactor system may be configured to fit in the same space as an existing lavatory trash can.

Embodiments of the present disclosure provide a trash compactor assembly that is configured to upwardly compact trash within a receptacle. That is, the compaction direction is upwardly from a bottom of the receptacle. The trash compactor assembly is manually operated (and devoid of a motor or other such powered drive system). In operation, an individual opens a door to a trash compartment of a trash containment system, and pulls on a cord to lift a bottom compaction plate to compact trash within the receptacle. The trash compactor assembly may occupy the same volume as a current trash bin within a lavatory of a commercial aircraft, for example, and may therefore be installed without any aircraft modification.

The trash compactor assembly provides a self-contained system that is compatible with known trash flap configuration and fire protection components within a lavatory of a commercial aircraft, for example. The trash compactor assembly provides a hygienic and efficient compaction system that is substantially lighter and more compact than known motorized compactors.

Figure 1:
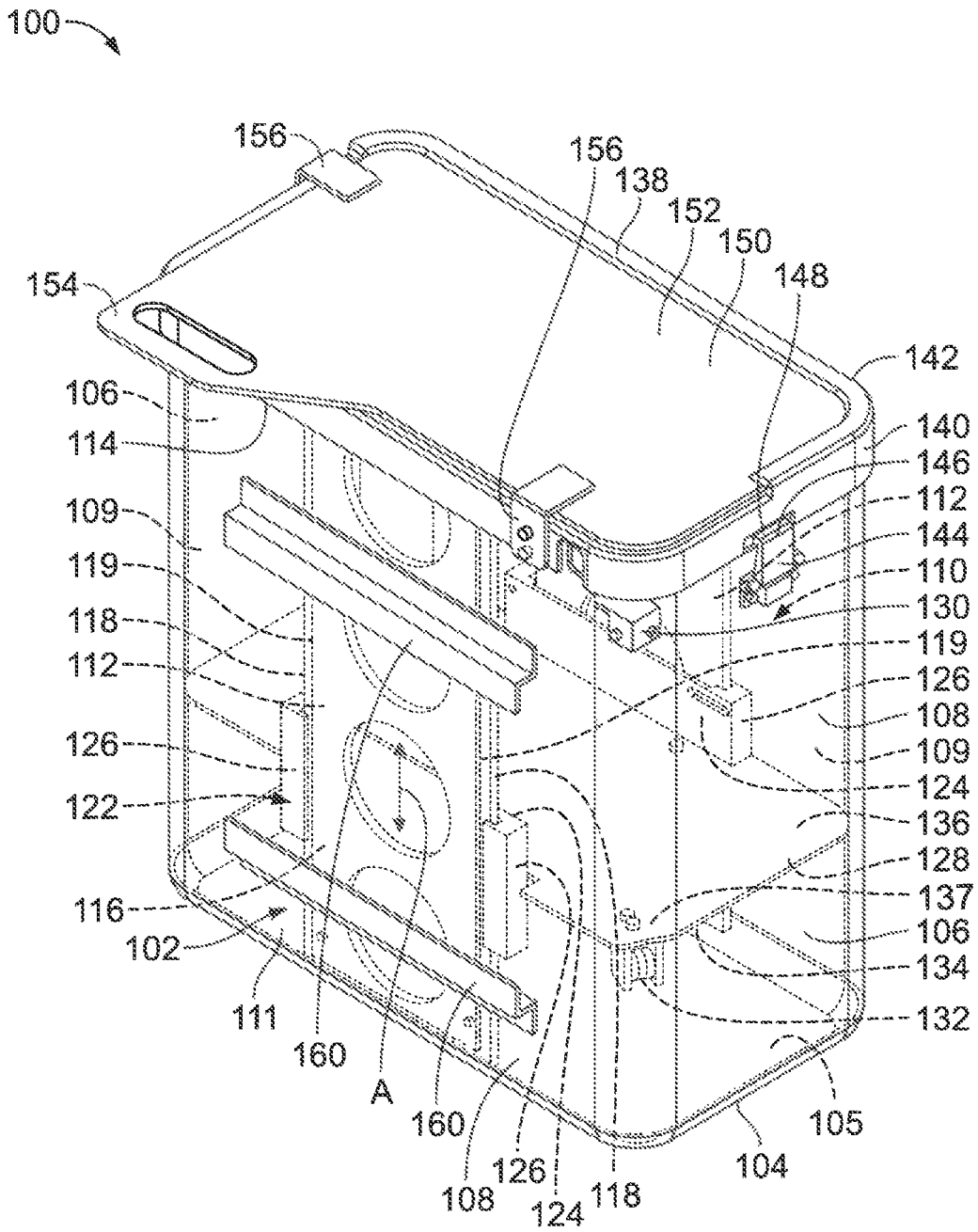
FIG. 1 illustrates a perspective top view of a trash compactor assembly, according to an embodiment of the present disclosure.

FIG. 1 illustrates a perspective top view of a trash compactor assembly 100, according to an embodiment of the present disclosure. The trash compactor assembly 100 includes a receptacle 102 (such as a bin) having a base 104 connected to end walls 106 and side walls 108. A retaining chamber 110 is defined between the base 104, the end walls 106, and the side walls 108. As shown, the receptacle 102 may be generally rectangular in shape. Optionally, the receptacle 102 may be square shaped, triangular, circular, or various other shapes. It is to be understood that end walls 106 and the side walls 108 are shown transparent in order to show internal components of the trash compactor assembly 100.

Opposed rails 112 are secured to interior surfaces 109 of the side walls 108. The opposed rails 112 are aligned with one another, and may extend from the base 104 to an upper edge 114 of the receptacle 102. Each rail 112 includes a main beam 116, which may be directly coupled to an interior surface 109 of a side wall 108, and end flanges 118 spaced apart from the interior surface 109 of the side wall 108. As such, slide gaps 119 are defined between the flanges 118 and the interior surfaces 109 of the side walls 108.

Slide brackets 122 are slidably secured to the rails 112. Each slide bracket 122 may include an interior panel 124 and end couplers 126 that slidably couple to the flanges 118. The slide brackets 122 are configured to vertically slide on the rails 112 in the direction of arrows A.

The slide brackets 122 are coupled to a compaction plate 128. The compaction plate 128 is configured to fit within the retaining chamber 110. The compaction plate 128 may reside in one or more planes that are generally parallel with an upper surface 105 of the base 104. In at least one embodiment, the compaction plate 128 may be integrally formed with the slide brackets 122.

An upper pulley 130 is secured to the receptacle 102 proximate to the upper edge 114. The upper pulley 130 may be located proximate to a junction between an end wall 106 and a side wall 108. The upper pulley 130 is configured to moveably retain the cord (not shown in FIG. 1), such as a one or more string(s), rope(s), cable(s), wire(s), and/or the like.

A lower pulley 132 may be secured to a lower surface 134 (opposite from an upper surface 136) of the compaction plate 128 underneath the upper pulley 130. As shown, the lower pulley 132 may be located at a first corner 137 of the compaction plate 128. Another pulley (not shown in FIG. 1) may be located at a second corner of the compaction plate 128 that is diagonally opposite from the first corner 137. Like the upper pulley 130, the lower pulley is configured to moveably retain a portion of the cord.

The cord may be routed from the upper pulley 130, the lower pulley 132, to the other pulley (not shown in FIG. 1), and to a fixed point within the receptacle 102. As such, when a free end of the cord is pulled outwardly away from the receptacle, the cord causes the compaction plate 128 to slide upwardly on the rails 112 via the slide brackets 122 from the base 104 towards the upper edge 114 of the receptacle 102. Conversely, when the cord is released, the free end of the cord recedes back towards the receptacle 102, and the compaction plate 128 moves back towards the base 104.

Optionally, the upper pulley 130 may connect to a fixed point of the compaction plate 128, without being routed to another pulley. In at least one other embodiment, additional pulleys may be positioned on the compaction plate 128 to route the cord therethrough. For example, the cord may be routed through four pulleys located at the four corners of the compaction plate 128.

Optionally, the rails 112 may be positioned on inner surfaces of the end walls 106 instead of (or in addition to) to the side walls 108. As such, the slide brackets 122 may be positioned on ends of the compaction plate 128 instead of (or in addition to) the sides of the compaction plate 128.

A securing collar 138 may be removably secured to the upper edge 114 of the receptacle 102. The securing collar 138 may include a perimeter wall 140 that extends around the receptacle 102 at and/or proximate to the upper edge 114. An upper lip 142 of the securing collar 138 may extend over at least a portion of the upper edge 114.

The receptacle 102 may include one or more latches 144 that latchably retain the securing collar 138 to the receptacle 102. For example, the latches 144 may include latching clips 146 that extend into reciprocal channels 148 of the securing collar 138. The latches 144 are configured to be moved between engaged positions (as shown in FIG. 1), in which they retain the securing collar 138, and disengaged positions, in which the securing collar 138 may be removed from the receptacle 102.

The trash compactor assembly 100 may also include an upper plate 150 having a main body 152 and a handle 154 extending outwardly from the main body 152. The upper plate 150 is configured to be removably positioned over the retaining chamber 110 (parallel to the base 104) so that trash may be compacted between the compaction plate 128 and the upper plate 150. In at least one embodiment, the upper plate 150 is configured to removably secure to the securing collar 138. For example, the upper plate 150 is configured to slide over the securing collar 138 and extend between the upper lip 142 of the securing collar 138 and the upper edge 114 of the receptacle 102. In this manner, the upper plate 150 may be secured to the upper plate 150. The upper plate 150 may be slid away from the securing collar 138.

One or more plate holders 156 may also extend from the securing collar 138 and retain the upper plate 150 in position. The plate holders 156 may be resilient clips, for example. The plate holders 156 may be formed of an elastomeric material (such as rubber), for example. As the upper plate 150 is pulled away from the securing collar 138, the plate holders 156 may deflect to allow removal of the securing collar 138. The securing collar 138 may include more or less plate holders 156 than shown. In at least one embodiment, only a single, deflectable or rigid plate holder 156 may be used. In at least one other embodiment, no plate holders are used.

Plate retainers 160 may outwardly extend from an outer surface 111 of the receptacle 102, such as an outer surface 111 of a side wall 108. The plate retainers 160 are sized and shaped to retain the upper plate 150 in a stored position, when the upper plate 150 is removed from the securing collar 138 and/or the upper edge 114 of the receptacle 102. Alternatively, the receptacle 102 may not include the plate retainers 160.

Optionally, the trash compactor assembly 100 may not include the securing collar 138. Instead, the upper plate 150 may be configured to be removably secured to and/or proximate to the upper edge 114 of the receptacle 102. In at least one embodiment, the upper plate 150 may have an axial cross sectional area that is less than the receptacle 102. In such an embodiment, a slot may be formed through a portion of the receptacle 102 proximate to the upper edge 114, and the upper plate 150 may be configured to be removably positioned into the slot.

Alternatively, the trash compactor assembly 100 may not include the upper plate 150. Instead, compaction via the upward movement of the compaction plate 128 may be between the upper surface 136 of the compaction plate 128 and a lower surface of a cover or the like of a trash containment system.

In at least one embodiment, a retaining bag (not shown) may be positioned within the retaining chamber 110 above the upper surface 136 of the compaction plate 128. The retaining bag may be configured to receive trash. In at least one other embodiment, the retaining bag may be a protective structure positioned above the compaction plate 128, and the retaining bag is configured to receive and retain a trash bag, which may be removed and discarded. Alternatively, trash may be directly deposited into the retaining chamber 110 without use of a retaining bag and/or additional trash bag.

As described herein, embodiments of the present disclosure provide the trash compactor assembly 100 that includes the receptacle 102 including the base 104 connected to at least one wall 106, 108 having the upper edge 114. The retaining chamber 110 is defined between the wall(s) 106, 108 and the upper edge 114. The compaction plate 128 is disposed within the retaining chamber 110. The compaction plate 128 is configured to be manually moved (that is, without the use of a motor or other automatically powered system) in an upward direction towards the upper edge 114 from the base 104 to compact trash within the retaining chamber 110.

Figure 2:
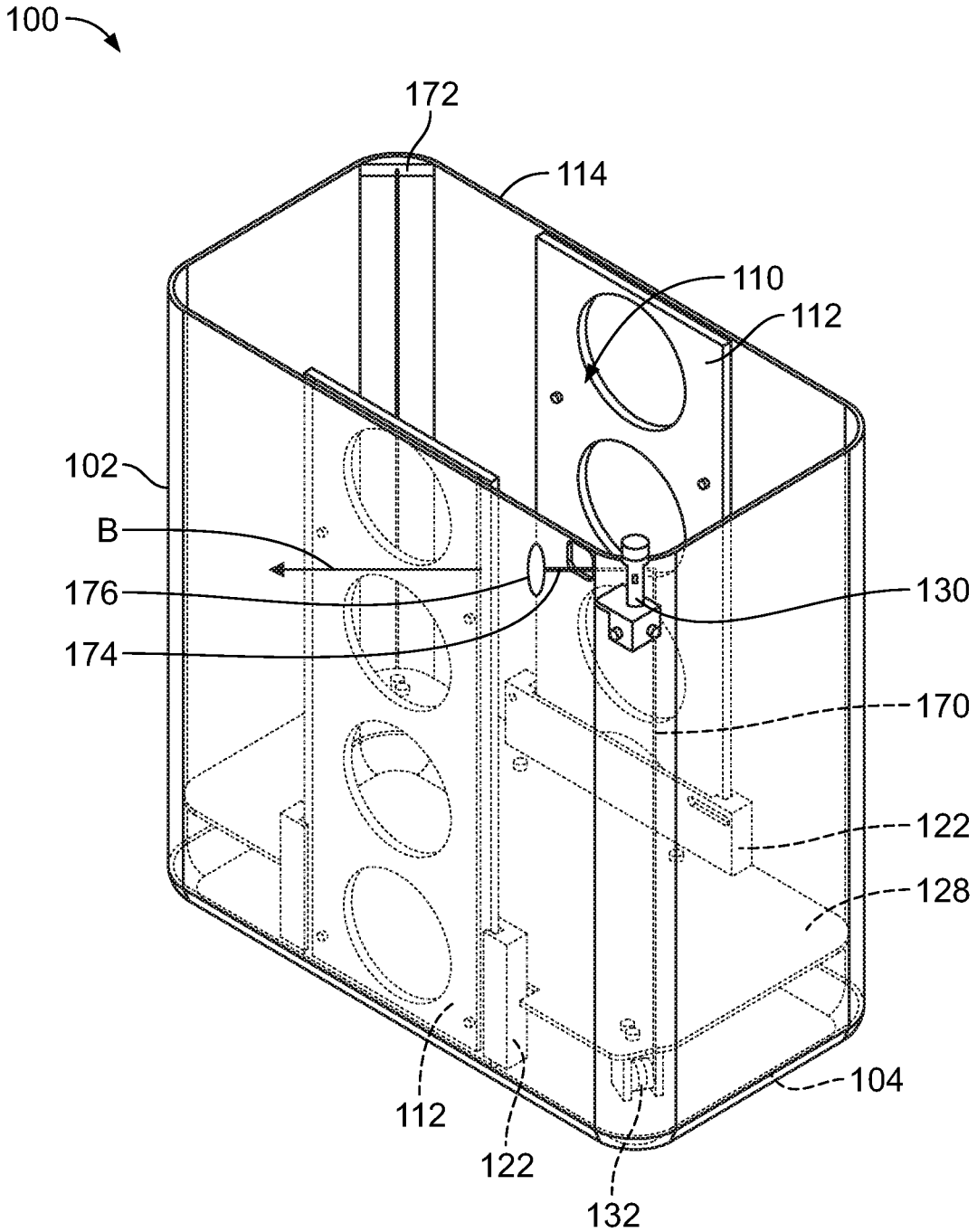
FIG. 2 illustrates a perspective top view of the trash compactor assembly with a compaction plate in a lower extended position, according to an embodiment of the present disclosure.

FIG. 2 illustrates a perspective top view of the trash compactor assembly 100 with the compaction plate 128 in a lower extended position, according to an embodiment of the present disclosure. As shown, the cord 170 is slidably routed through the upper the first lower pulley 132, a second lower pulley (not shown) diagonally opposite from the first lower pulley, and securely fixed to an anchor 172 extending from the upper edge 114 of the receptacle 102 diagonally opposite from the upper pulley 130. That is, a fixed end of the cord 170 is securely fixed to the anchor 172. A free end 174 of the cord outwardly extends from the receptacle 102 proximate to the upper pulley 130. A grasping handle 176 (such as a knob, expanded end, or the like) may be secured to the free end 174.

The cord 170 is coupled to the compaction plate 128 in order to provide a compacting motion (such as an in upward direction) of the compaction plate 128. As the cord 170 is pulled, the motion of the cord 170 causes a corresponding upward motion of the compaction plate 128. In at least one embodiment, the cord 170 is coupled to the compaction plate 128 through one or more pulleys. The cord 170 may also be coupled to the receptacle 102, such as through the upper pulley 130, and the fixed anchor 172.

Figure 3:
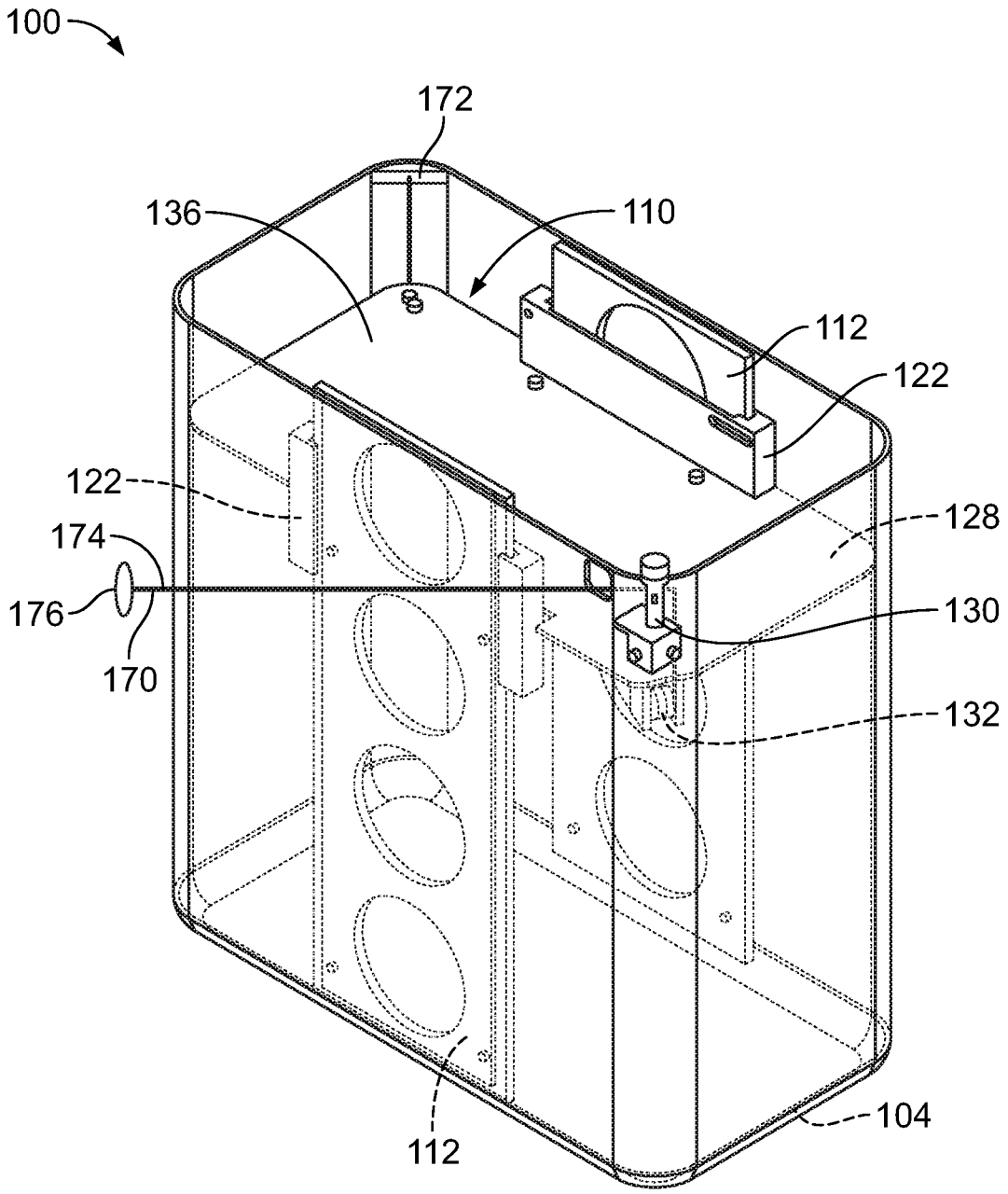
FIG. 3 illustrates a perspective top view of the trash compactor assembly with the compaction plate in an upper compacting position, according to an embodiment of the present disclosure.

FIG. 3 illustrates a perspective top view of the trash compactor assembly 100 with the compaction plate 128 in an upper compacting position, according to an embodiment of the present disclosure. Referring to FIGS. 2 and 3, as the handle 176 at the free end 174 of the cord 170 is pulled away from the receptacle 102 in the direction of arrow B, the pulleys 130, 132, and/or the like cooperate with the moving cord 170 to move the compaction plate 128 upwardly towards the upper edge 114 of the receptacle 102 via the slide brackets 122 sliding over the rails 112. In this manner, trash within the retaining chamber 110 is compacted between the upper surface 136 of the compaction plate 128 and a lower surface of the upper plate 150 (when positioned over and/or proximate to the upper edge 114 of the receptacle 102, as shown in FIG. 1) or a lower surface of another structure (such as a portion of a trash containment system).

When the handle 176 is released, the weight of the compaction plate 128 moves the compaction plate 128 back down towards the base 104 via gravity into the lower extended position as shown in FIG. 2. During such movement, the free end 174 of the cord 170 recedes back towards the receptacle 102 as the compaction plate 128 slides back down to the lower extended position via sliding motion of the slide brackets 122 over the rails 112. In at least one embodiment, the trash compactor assembly 100 may include one or more springs on or within the compaction plate 128, the slide brackets 122, the rails 112, or other portions that spring bias the compaction plate 128 back to the lower extended position when the cord 170 is not pulled away from the receptacle 102.

Figure 4:
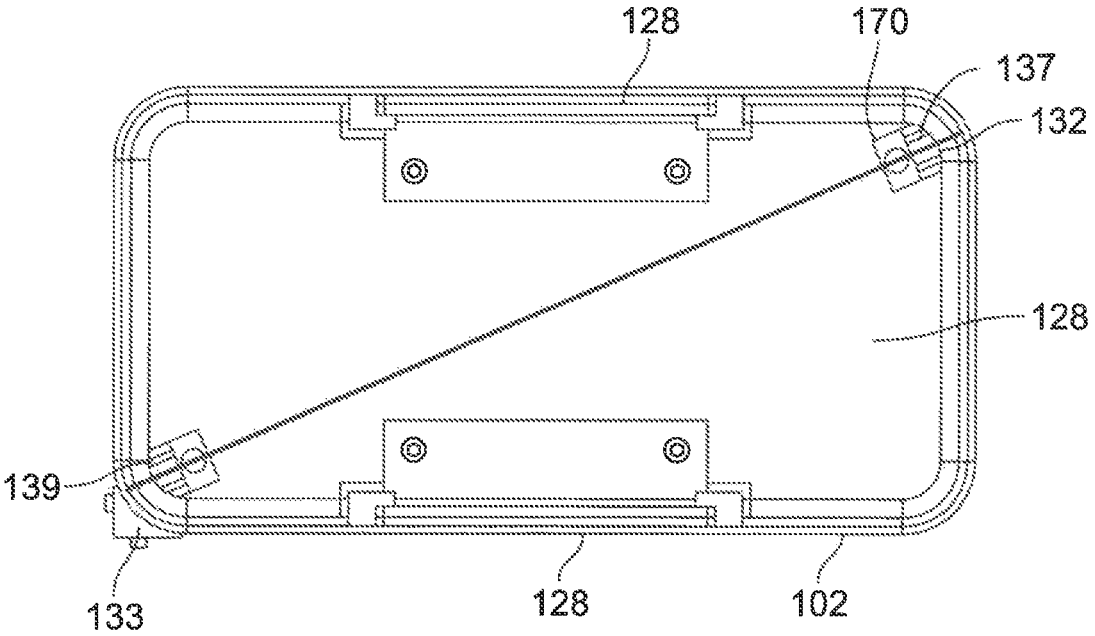
FIG. 4 illustrates a bottom view of the trash compactor assembly, according to an embodiment of the present disclosure.

FIG. 4 illustrates a bottom view of the trash compactor assembly 100, according to an embodiment of the present disclosure. As shown, the cord 170 may moveably extend between the first lower pulley 132 at the first corner 137 of the compaction plate 128, and a second lower pulley 133 at a second corner 139 that is diagonally opposite from the first corner 137. Accordingly, the cord 170 may extend between diagonally opposite corners of the receptacle 102 and underneath the receptacle 102. The use of the first lower pulley 132 and the second lower pulley 133 allows for a smooth slidable motion of the compaction plate 128 that is less susceptible to binding. Alternatively, the cord 170 may be fixed to a portion of the compaction plate 128 without the use of one or both of the first lower pulley 132 and the second lower pulley 133.

Figure 5:
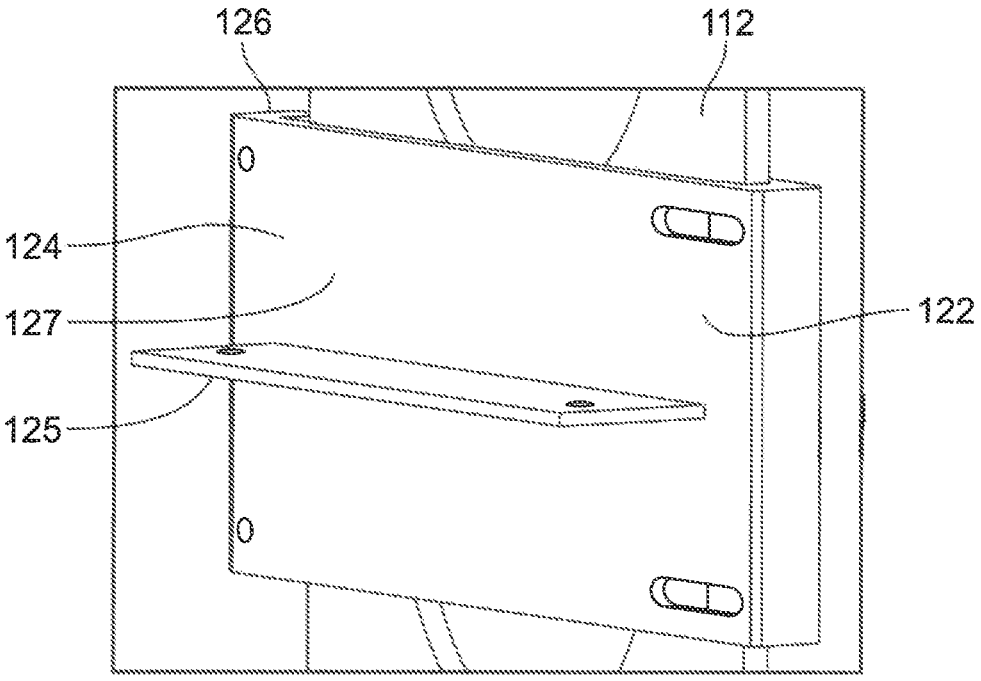
FIG. 5 illustrates a perspective interior view of a slide bracket slidably coupled to a rail, according to an embodiment of the present disclosure.

FIG. 5 illustrates a perspective interior view of a slide bracket 122 slidably coupled to a rail 112, according to an embodiment of the present disclosure. A ledge 125 may inwardly extend from an interior surface 127 of the interior panel 124. The compaction plate 128 (shown in FIGS. 1-4) may be supported by the ledges 125 of the opposed slide brackets 122. In at least one embodiment, the compaction plate 128 may be secured to the ledges 125, such as through fasteners, adhesives, and/or the like. In at least one other embodiment, the compaction plate 128 rests over the ledges 125 without being permanently fixed thereto. In at least one other embodiment, the compaction plate 128 may be integrally molded and formed with the slide brackets 122.

Referring to FIGS. 1-5, the slide brackets 122 and/or the rails 112 may be formed of a low-friction material, such as Teflon. The slide brackets 122 may be sized and shaped with respect to the rails 112 in relation to a binding ratio, which is a maximum ratio of moment arm distance to bearing length that prevents binding.

Figure 6:
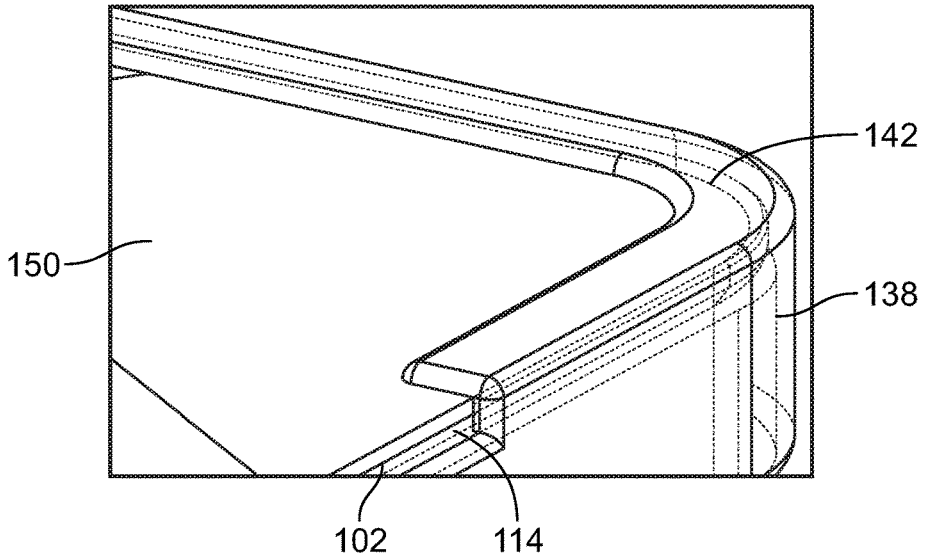
FIG. 6 illustrates a perspective top view of an upper plate secured to a securing collar, according to an embodiment of the present disclosure.

FIG. 6 illustrates a perspective top view of the upper plate 150 secured to the securing collar 138, according to an embodiment of the present disclosure. As shown, an outer edge of the upper plate 150 is configured to slide over and/or into the securing collar 138 and extend between the upper lip 142 of the securing collar 138 and the upper edge 114 of the receptacle 102. In this manner, the upper plate 150 may be secured to the upper plate 150.

Figure 7:
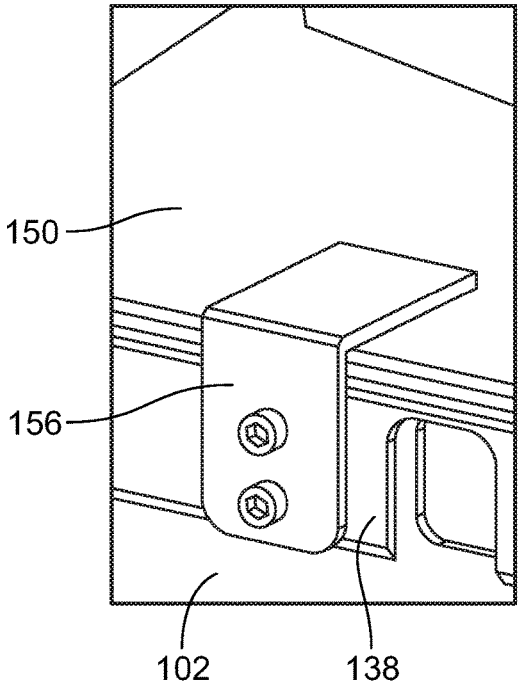
FIG. 7 illustrates a perspective top view of a plate holder retaining a portion of the upper plate, according to an embodiment of the present disclosure.

FIG. 7 illustrates a perspective top view of a plate holder 156 retaining a portion of the upper plate 150, according to an embodiment of the present disclosure. One or more plate holders 156 may extend from the securing collar 138 and retain the upper plate 150 in position.

Figure 8:
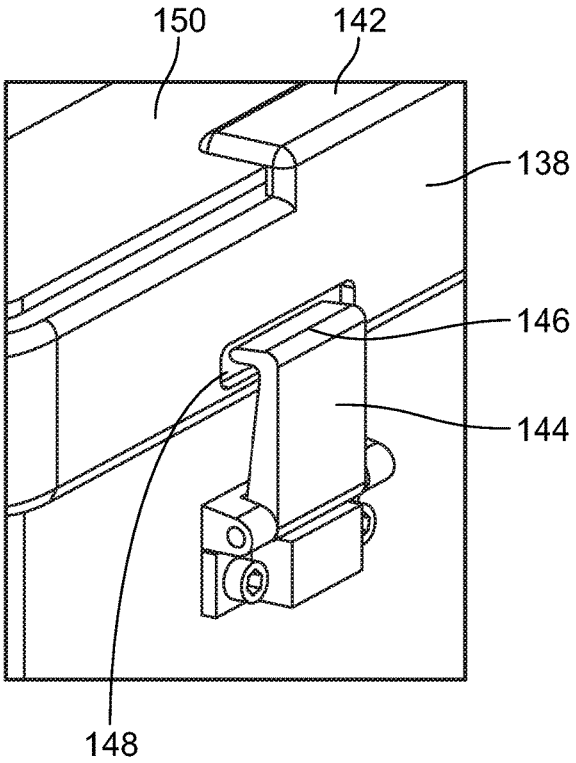
FIG. 8 illustrates a perspective top view of a latch securely engaging a portion of the securing collar, according to an embodiment of the present disclosure.

FIG. 8 illustrates a perspective top view of a latch 144 securely engaging a portion of the securing collar 138, according to an embodiment of the present disclosure. As noted, the latch 144 may include a latching clip 146 that extends into a reciprocal channel 148 of the securing collar 138. The latches 144 are configured to be pivoted between engaged positions (as shown in FIG. 8), in which they retain the securing collar 138, and disengaged positions, in which the securing collar 138 may be removed from the receptacle 102.

Figure 9:
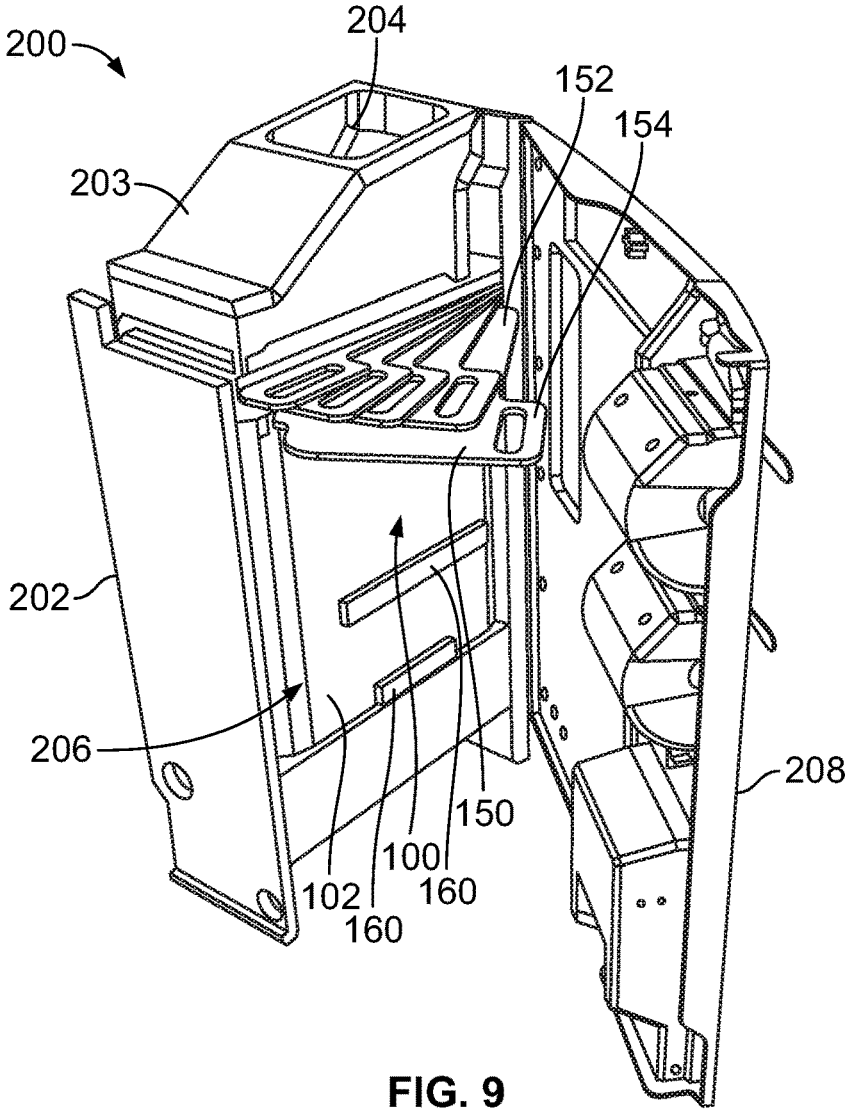
FIG. 9 illustrates a perspective front view of a trash containment system including the trash compactor assembly, according to an embodiment of the present disclosure.

FIG. 9 illustrates a perspective front view of a trash containment system 200 including the trash compactor assembly 100, according to an embodiment of the present disclosure. The trash containment system 200 includes a fixed outer wall 202 connected to an upper wall 203 having a trash-receiving opening 204. A trash compartment 206 is defined between the outer wall 202 and the upper wall 203. An access door 208 is moveably secured to the outer wall 202 and/or the upper wall 203, such as through one or more hinges. The access door 208 is configured to be moved between an open position (in which the trash compartment 206 is exposed) and a closed position (in which the trash compartment 206 is covered). The outer wall 202, the upper wall 203, and the access door 208 may be sized and shaped differently than shown.

Figure 10:
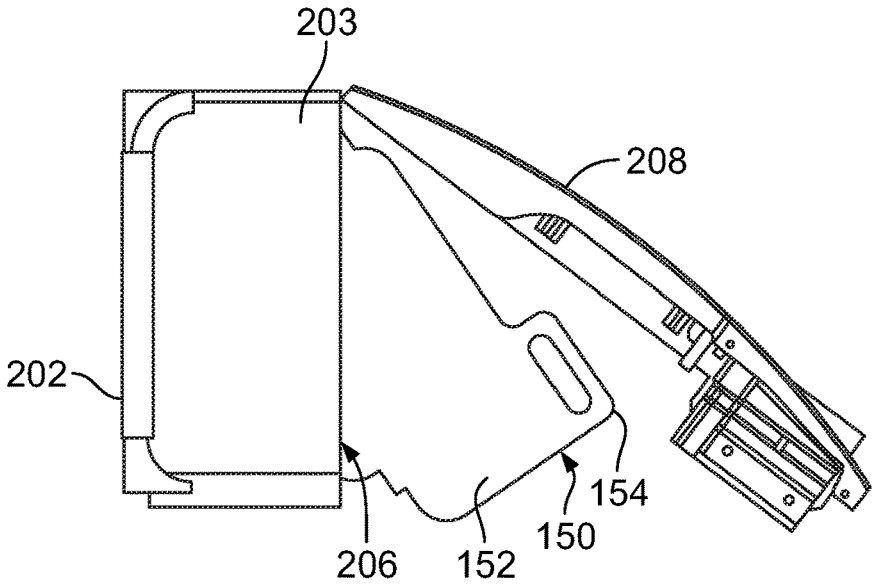
FIG. 10 illustrates a top view of the trash containment system including the trash compactor assembly, according to an embodiment of the present disclosure.

FIG. 10 illustrates a top view of the trash containment system 200 including the trash compactor assembly 100, according to an embodiment of the present disclosure. Referring to FIGS. 9 and 10, as shown, the handle 154 of the upper plate 150 outwardly extends from the main body 152. As such, the axial cross section of the upper plate 150 is greater than the axial cross-section of the trash compartment 206. As such, the access door 208 is not able to be fully closed if the upper plate 150 is still positioned over the receptacle 102, thereby alerting an individual that the upper plate 150 needs to be removed in order for the trash compartment 206 to receive trash. That is, when positioned over the receptacle 102, the handle 154 of the upper plate 150 extends outwardly past the axial cross section of the trash compartment 206 in order to prevent individuals from accidently closing the trash compartment 206 with the upper plate 150 still positioned over the receptacle 102.

In at least one embodiment, the upper plate 150 is slid over the receptacle 102 at an angle, such as if the maximum opening angle (such as shown in FIG. 10, in particular) of the access door 208 is less than 90 degrees. When not in use, the upper plate 150 may be retained by the plate retainers 160. Alternatively, the upper plate 150 may not include a portion that extends past an axial cross section of the trash compartment 206.

Figure 11:
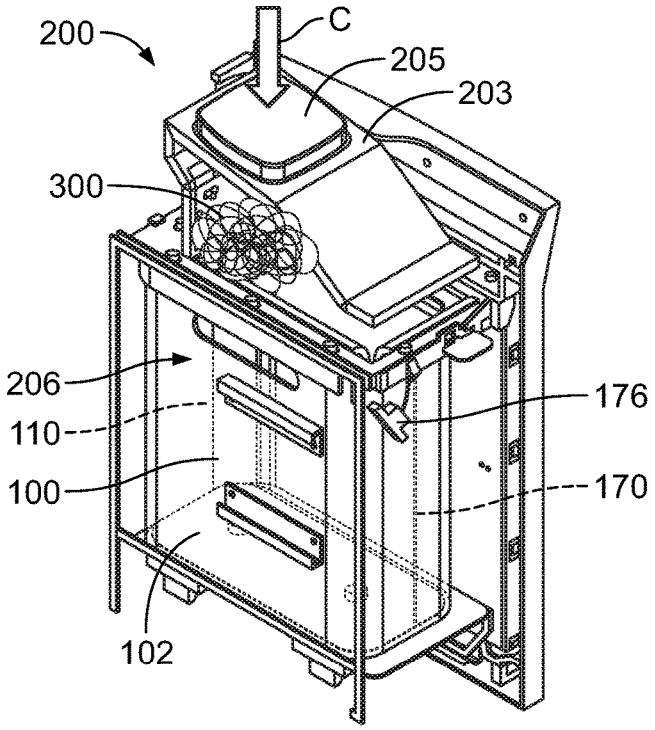
FIG. 11 illustrates a perspective top view of the trash containment system receiving trash, according to an embodiment of the present disclosure.

FIG. 11 illustrates a perspective top view of the trash containment system 200 receiving trash 300, according to an embodiment of the present disclosure. In order to deposit the trash 300 into the trash compartment 206, the trash 300 is urged in the direction of arrow C through a pivotal flap 205 (covering the opening 204) that is pivotally coupled to the upper wall 203. Because the upper plate 150 (shown in FIGS. 9 and 10, for example) is not positioned over the receptacle 102, the trash 300 falls into the retaining chamber 110 of the receptacle 102.

Figure 12:
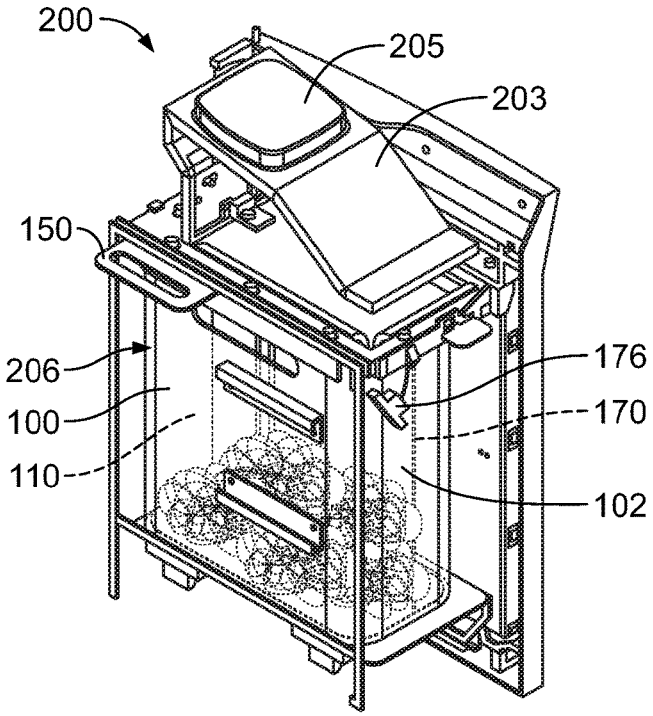
FIG. 12 illustrates a perspective top view of the trash containment system having trash retained within a receptacle of the trash compactor assembly, according to an embodiment of the present disclosure.

FIG. 12 illustrates a perspective top view of the trash containment system 200 having trash 300 retained within the receptacle 102 of the trash compactor assembly 100, according to an embodiment of the present disclosure. As trash 300 accumulates within the retaining chamber 110, an individual may decide to compact the trash 300 to provide more room within the retaining chamber 110. In order to compact the trash, the access door 208 (shown in FIGS. 9 and 10) may first be opened, in order to expose the trash compactor assembly 100 within the trash compartment 206.

Figure 13:
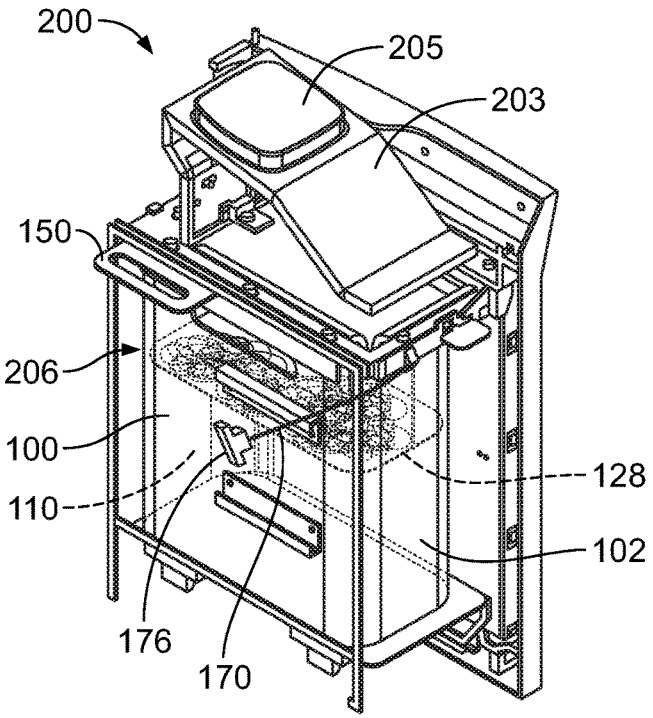
FIG. 13 illustrates a perspective top view of the trash containment system having trash compacted by the trash compactor assembly, according to an embodiment of the present disclosure.

FIG. 13 illustrates a perspective top view of the trash containment system 200 having trash 300 compacted by the trash compactor assembly 100, according to an embodiment of the present disclosure. The upper plate 150 may be temporarily secured over the receptacle 102. The handle 176 is grasped, and the cord 170 is outwardly pulled. As the cord 170 is outwardly pulled away from the receptacle 102, the compaction plate 128 slides upwardly towards the upper plate 150, thereby compacting the trash 300 therebetween. Thus, the trash 300 is compacted by the compaction plate 128 upwardly moving within the retaining chamber 110 of the receptacle 102.

Figure 14:
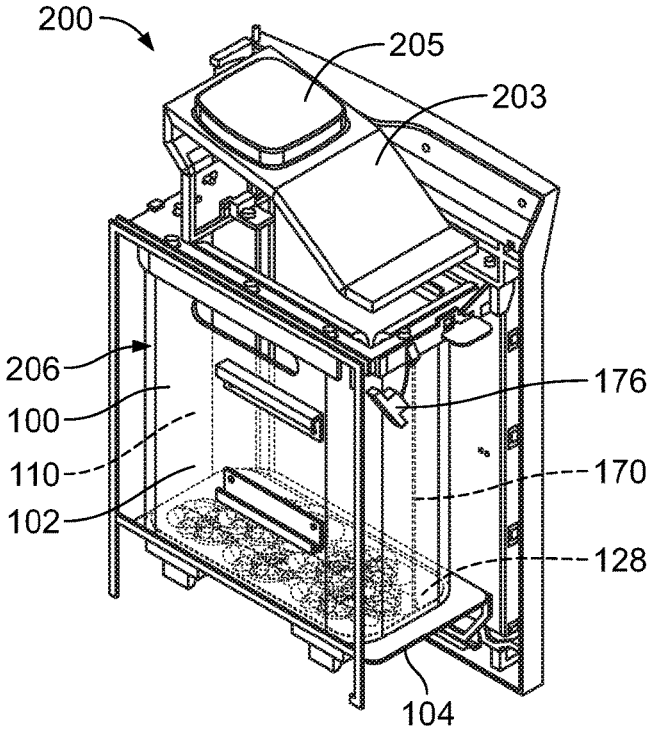
FIG. 14 illustrates a perspective top view of the trash containment system having compacted trash retained within the receptacle of the trash compactor assembly, according to an embodiment of the present disclosure.

FIG. 14 illustrates a perspective top view of the trash containment system 200 having compacted trash 300 retained within the receptacle 102 of the trash compactor assembly 100, according to an embodiment of the present disclosure. As the cord 170 is released, the compaction plate 128 falls back down towards the base 104 of the receptacle 102, with the compacted trash falling down towards the base 104 along with the compaction plate 128. After the trash 300 is compacted, the upper plate 150 (shown in FIGS. 12 and 13) is removed off the top of the receptacle 102. The access door 208 (shown in FIGS. 9 and 10) may then be closed.

Figure 15:
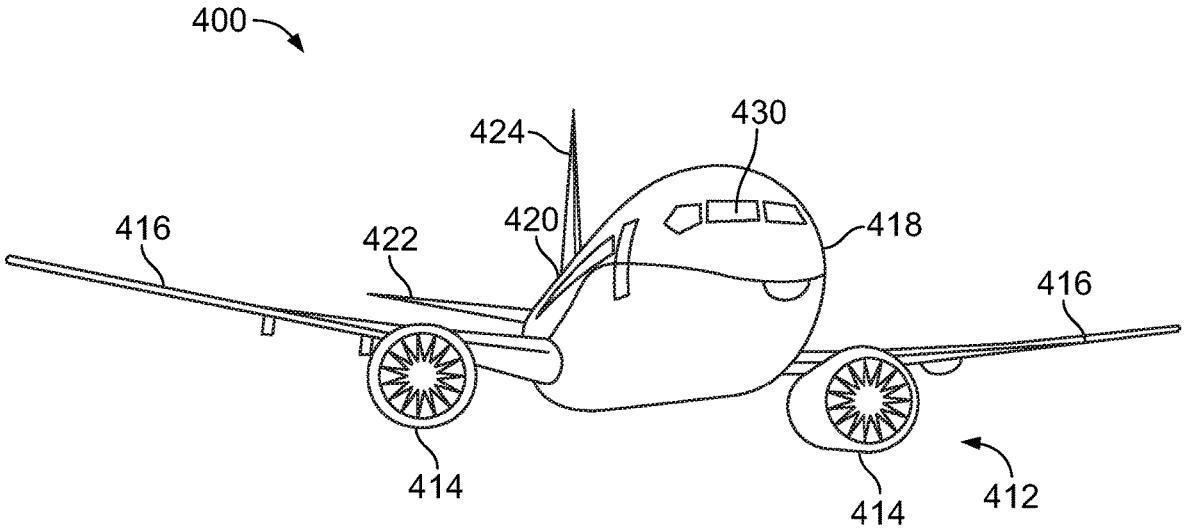
FIG. 15 illustrates a perspective front view of an aircraft, according to an embodiment of the present disclosure.

FIG. 15 illustrates a perspective front view of an aircraft 400, according to an embodiment of the present disclosure. The aircraft 400 includes a propulsion system 412 that may include two turbofan engines 414, for example. Optionally, the propulsion system 412 may include more engines 414 than shown. The engines 414 are carried by wings 416 of the aircraft 400. In other embodiments, the engines 414 may be carried by a fuselage 418 and/or an empennage 420. The empennage 420 may also support horizontal stabilizers 422 and a vertical stabilizer 424.

The fuselage 418 of the aircraft 400 defines an internal cabin 430, which may include a cockpit, one or more work sections (for example, galleys, personnel carry-on baggage areas, and the like), one or more passenger sections (for example, first class, business class, and coach sections), one or more lavatories, and/or the like. The internal cabin 430 includes one or more chambers, such as lavatories and galleys, for example. One or more of the chambers may include a trash compactor assembly 100 within a trash containment system 200, for example, such as shown and described with respect to FIGS. 1-14.

Alternatively, instead of an aircraft, embodiments of the present disclosure may be used with various other vehicles, such as automobiles, buses, locomotives and train cars, watercraft, and the like. Further, embodiments of the present disclosure may be used with respect to fixed structures, such as commercial and residential buildings.

Figure 16:
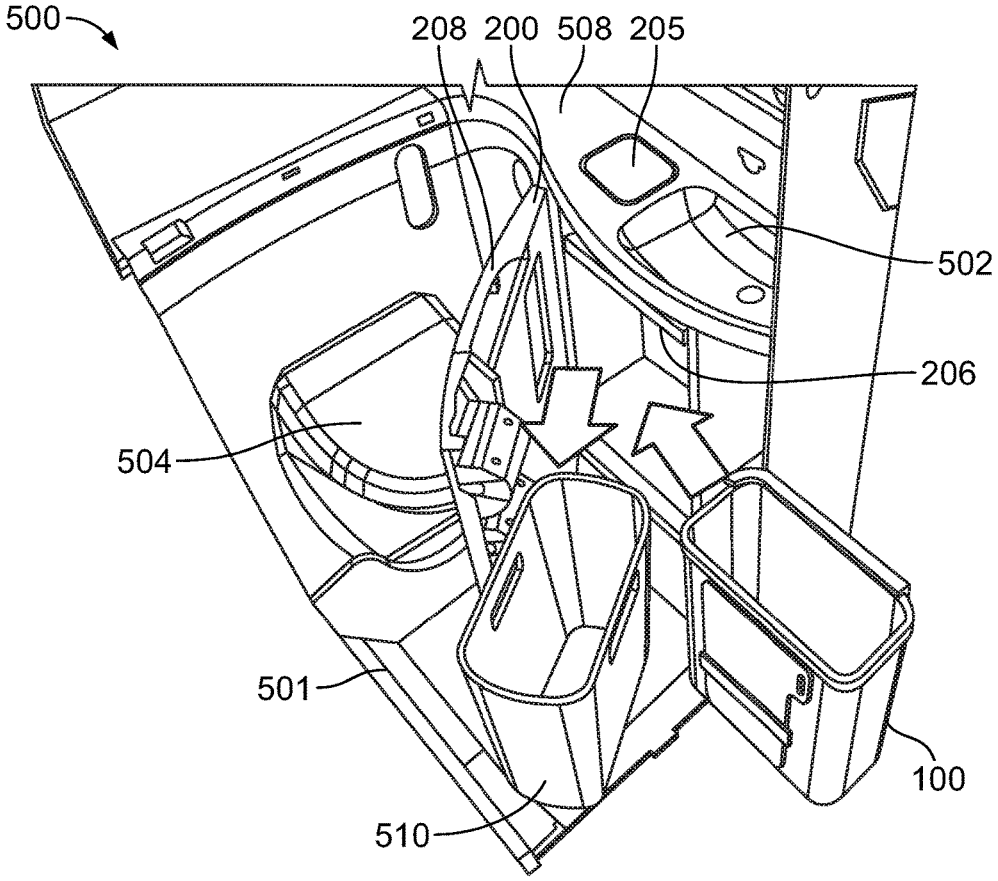
FIG. 16 illustrates a perspective internal view of a lavatory, according to an embodiment of the present disclosure.

FIG. 16 illustrates a perspective internal view of a lavatory 500, according to an embodiment of the present disclosure. The lavatory 500 is an example of an enclosed space or chamber, such as within the internal cabin of the aircraft 400, shown in FIG. 15. The lavatory 500 may be onboard an aircraft, as described above. Optionally, the lavatory 500 may be onboard various other vehicles. In other embodiments, the lavatory 500 may be within a fixed structure, such as a commercial or residential building.

The lavatory 500 includes a base floor 501 that supports a toilet 504, cabinets (such as the trash containment system 200), and a sink 502. The trash containment system 200 may be located underneath the sink 502. The flap 205 may be exposed through a countertop 508. As shown, a standard trash bin 510 may be removed from the trash compartment 206 that is exposed by the open access door 208, and the trash compactor assembly 100 (which may generally be sized and shaped the same as the standard trash bin 510) may be inserted into the trash compartment 206. The trash compactor assembly 100 may be located within the lavatory 500, such as underneath or otherwise proximate to the sink 502. As described above, the trash compactor assembly 100 is light, compact, and particularly well-suited to fit within the confined, limited space of an aircraft lavatory.

Figure 17:
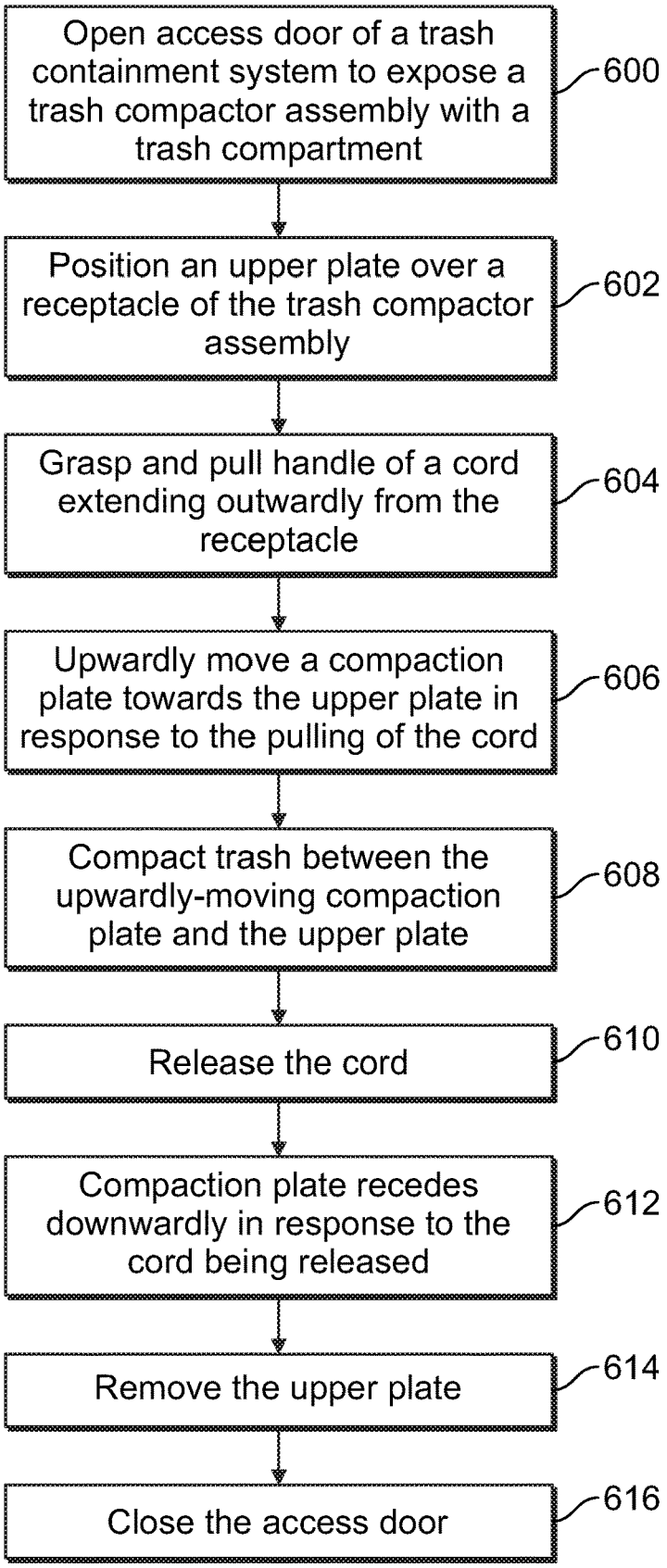
FIG. 17 illustrates a flow chart of a method of compacting trash within a trash containment system, according to an embodiment of the present disclosure.

FIG. 17 illustrates a flow chart of a method of compacting trash within a trash containment system, according to an embodiment of the present disclosure. Referring to FIGS. 1-17, at 600, the access door 208 of the trash containment system 200 is opened to expose the trash compactor assembly 100 within the trash compartment 206. At 602, the upper plate 150 may be positioned over the receptacle 102 of the trash compactor assembly 100.

At 604, an individual grasps and pulls the handle 176 of the cord 170 extending outwardly from the receptacle 102. At 606, the compaction plate 128 is moved upwardly towards the upper plate 150 (and/or the upper edge 114 of the receptacle 102) in response to the pulling of the cord 170.

At 608, trash 300 between the upwardly-moving compaction plate 128 and the upper plate 150 is compacted. At 610, the cord 170 is released. At 612, the compaction plate 128 recedes back downwardly in response to the cord 170 being released.

At 614, the upper plate 150 is removed off the top of the receptacle 102. At 616, the access door 208 is closed.

As described herein, embodiments of the present disclosure provide compact and efficient trash compactor assemblies, systems, and methods. Further, embodiments of the present disclosure provide a trash compactor assembly that may be employed within a lavatory of a commercial aircraft.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A trash compactor assembly, comprising:

a receptacle including a base connected to at least one wall, wherein the at least one wall has an upper edge, wherein a retaining chamber is defined between the at least one wall and the upper edge;

a compaction plate disposed within the retaining chamber, wherein the compaction plate is configured to be manually moved in an upward direction from the base towards the upper edge to compact trash within the retaining chamber;

a cord extending outwardly from the receptacle and coupled to the compaction plate, wherein the cord has a free end that is configured to be outwardly pulled away from the receptacle, and wherein the compaction plate moves upwardly in response to the free end of the cord being outwardly pulled away from the receptacle; and a grasping handle secured to the free end of the cord, wherein the grasping handle is configured to be manually grasped and pulled.

2. The trash compactor assembly of claim 1, further comprising one or more rails that extend between the base and the upper edge, wherein the compaction plate is slidably coupled to the receptacle through one or more rails.

3. The trash compactor assembly of claim 2, further comprising one or more slide brackets that slidably couple the compaction plate to the receptacle.

4. The trash compactor assembly of claim 1, further comprising a first pulley coupled to the receptacle, wherein the first pulley moveably couples to the cord that couples to the compaction plate.

5. The trash compactor assembly of claim 4, further comprising a second pulley coupled to the compaction plate, wherein the second pulley is also moveably coupled to the cord.

6. The trash compactor assembly of claim 5, further comprising a third pulley coupled to the compaction plate, wherein the third pulley is also moveably coupled to the cord.

7. The trash compactor assembly of claim 6, wherein the second pulley is secured to a first corner of the compaction plate, and wherein the third pulley is secured to a second corner of the compaction plate that is diagonally opposite from the first corner.

8. The trash compactor assembly of claim 5, further comprising an anchor secured to the receptacle, wherein the cord is secured to the anchor.

9. The trash compactor assembly of claim 1, further comprising a securing collar that is removably secured to the upper edge of the receptacle, wherein the securing collar is configured to removably retain an upper plate.

10. The trash compactor assembly of claim 1, further comprising an upper plate that is removably secured over the retaining chamber of the receptacle proximate to the upper edge, wherein the compaction plate and the upper plate are configured to compact the trash therebetween.

11. The trash compactor assembly of claim 10, wherein the upper plate comprises a main body and a handle extending outwardly from the main body, wherein the handle is configured to prevent an access door of a trash containment system from closing when the upper plate is positioned over the retaining chamber.

12. The trash compactor assembly of claim 10, wherein the receptacle further comprises one or more plate retainers that are configured to retain the upper plate in a stored position.

13. A trash compacting method, comprising:

providing a receptacle including a base connected to at least one wall, wherein the at least one wall has an upper edge, wherein a retaining chamber is defined between the at least one wall and the upper edge;

disposing a compaction plate within the retaining chamber; and configuring the compaction plate to be manually moved in an upward direction from the base towards the upper edge to compact trash within the retaining chamber, wherein a cord extends outwardly from the receptacle and is coupled to the compaction plate, wherein the cord has a free end that is configured to be outwardly pulled away from the receptacle, wherein a grasping handle is secured to the free end of the cord, wherein the grasping handle is configured to be manually grasped and pulled, and wherein the compaction plate moves upwardly in response to the free end of the cord being outwardly pulled away from the receptacle.

14. The trash compacting method of claim 13, further comprising:

coupling a first pulley to the receptacle; and moveably coupling the cord to the first pulley.

15. The trash compacting method of claim 14, further comprising:

coupling a second pulley to the compaction plate; and moveably coupling the cord to the second pulley.

16. The trash compacting method of claim 15, further comprising:

coupling a third pulley to the compaction plate; and moveably coupling the cord to the third pulley.

17. The trash compacting method of claim 15, further comprising:

securing an anchor to the receptacle; and securing the cord to the anchor.

18. The trash compacting method of claim 13, further comprising removably securing an upper plate over the retaining chamber of the receptacle proximate to the upper edge, wherein the compaction plate and the upper plate are configured to compact the trash therebetween.

19. A vehicle comprising:

an internal cabin;

a lavatory within the internal cabin; and a trash containment system within the lavatory, wherein the trash containment system comprises:

an outer wall;

an upper wall connected to the outer wall, wherein the upper wall includes a trash-receiving opening, wherein a trash compartment is defined between the outer wall and the upper wall;

an access door moveably coupled to one or both of the outer wall and the upper wall, wherein the access door is configured to be moved between an open position in which the trash compartment is exposed and a closed position in which the trash compartment is covered; and a trash compactor assembly positioned within the trash compartment, wherein the trash compactor comprises:

a receptacle including a base connected to at least one wall, wherein the at least one wall has an upper edge, wherein a retaining chamber is defined between the at least one wall and the upper edge;

a compaction plate disposed within the retaining chamber, wherein the compaction plate is configured to be manually moved in an upward direction from the base towards the upper edge to compact trash within the retaining chamber;

a cord extending outwardly from the receptacle and coupled to the compaction plate, wherein the cord has a free end that is configured to be outwardly pulled away from the receptacle, and wherein the compaction plate moves upwardly in response to the free end of the cord being outwardly pulled away from the receptacle; and a grasping handle secured to the free end of the cord, wherein the grasping handle is configured to be manually grasped and pulled.

20. The vehicle of claim 19, wherein the trash compactor assembly further comprises:

one or more rails that extend between the base and the upper edge, wherein the compaction plate is slidably coupled to the receptacle through one or more rails; and one or more slide brackets that slidably couple the compaction plate to the receptacle.

* * * * *